US008555635B2

(12) United States Patent
Webster et al.

(10) Patent No.: US 8,555,635 B2
(45) Date of Patent: Oct. 15, 2013

(54) HYDRAULIC SYSTEM FOR SYNCHRONIZING A PLURALITY OF PISTONS AND AN ASSOCIATED METHOD

(75) Inventors: Ryan W. Webster, Livonia, MI (US); Greg Lucas, Leaf River, IL (US)

(73) Assignee: Hallite Seals Americas, Inc., Troy, MI (US)

( * ) Notice: Subject to any disclaimer, the term of this patent is extended or adjusted under 35 U.S.C. 154(b) by 915 days.

(21) Appl. No.: 12/688,112

(22) Filed: Jan. 15, 2010

(65) Prior Publication Data

US 2010/0199653 A1 Aug. 12, 2010

Related U.S. Application Data

(60) Provisional application No. 61/144,868, filed on Jan. 15, 2009.

(51) Int. Cl.
*F15B 7/08* (2006.01)
*F15B 15/00* (2006.01)

(52) U.S. Cl.
USPC ..... 60/546; 91/189 A; 92/57; 92/158

(58) Field of Classification Search
USPC ..... 91/189 A, 400, 402; 92/158, 159, 181 R, 92/182; 60/546
See application file for complete search history.

(56) References Cited

U.S. PATENT DOCUMENTS 3,132,568 A 5/1964 Strader
3,153,987 A 10/1964 Thoma
3,155,014 A 11/1964 Genz
3,832,852 A 9/1974 Schmucker
4,108,048 A * 8/1978 Gauss et al. ..... 91/499
4,111,104 A 9/1978 Davison, Jr.
4,164,122 A 8/1979 Ward
4,463,563 A 8/1984 Krehbiel
4,557,488 A 12/1985 Litherland
5,611,260 A 3/1997 Kanari et al.
5,676,380 A 10/1997 Sell
5,816,134 A * 10/1998 Takenaka et al. ..... 92/158
6,324,959 B1 * 12/2001 Akasaka et al. ..... 92/158
(Continued)

FOREIGN PATENT DOCUMENTS

EP 1889767 2/2008

*Primary Examiner* — Thomas E Lazo
(74) *Attorney, Agent, or Firm* — Howard & Howard Attorneys PLLC

(57) ABSTRACT

A hydraulic system for use with a pressurized fluid includes a first cylinder and a second cylinder. A flow path links the first and second cylinders in fluid communication with each other. A first piston is disposed within the first cylinder and defines a first axis and a second piston disposed within the second cylinder. The first piston is movable along the first axis between a variety of operating positions and a rephasing position. The first piston has an exterior surface that defines a peripheral groove and several flutes. The flutes are oriented such that they are parallel to the first axis and intersect the peripheral groove, allowing the fluid to flow from the first cylinder across the flow path and into the second cylinder when the first piston is in the rephasing position thereby automatically rephasing the first and second pistons within the hydraulic system.

21 Claims, 5 Drawing Sheets

(56) References Cited

U.S. PATENT DOCUMENTS

| | | | | |
|---|---|---|---|---|
| 6,591,948 | B2 | 7/2003 | Casellas et al. | |
| 6,685,193 | B2 | 2/2004 | Roberts et al. | |
| 6,928,923 | B2 | 8/2005 | May | |
| 7,424,846 | B2 * | 9/2008 | Tanizaki et al. | 92/181 R |
| 7,537,079 | B2 | 5/2009 | Krieger et al. | |
| 2002/0056368 | A1 | 5/2002 | May | |
| 2007/0144819 | A1 | 6/2007 | Krieger et al. | |
| 2008/0098886 | A1 | 5/2008 | Lindsten et al. | |

* cited by examiner

FIG. 4
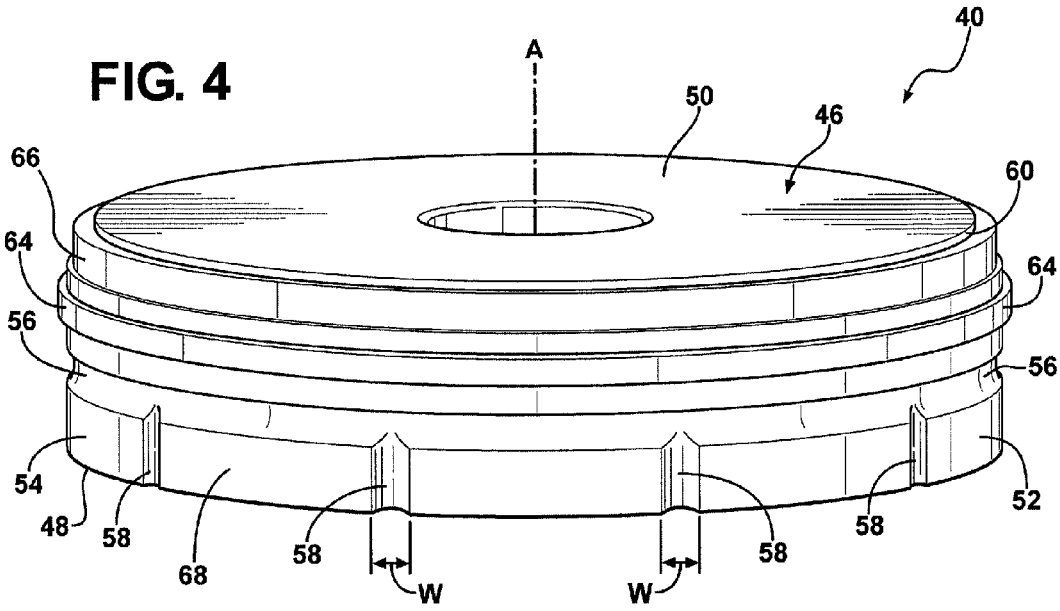
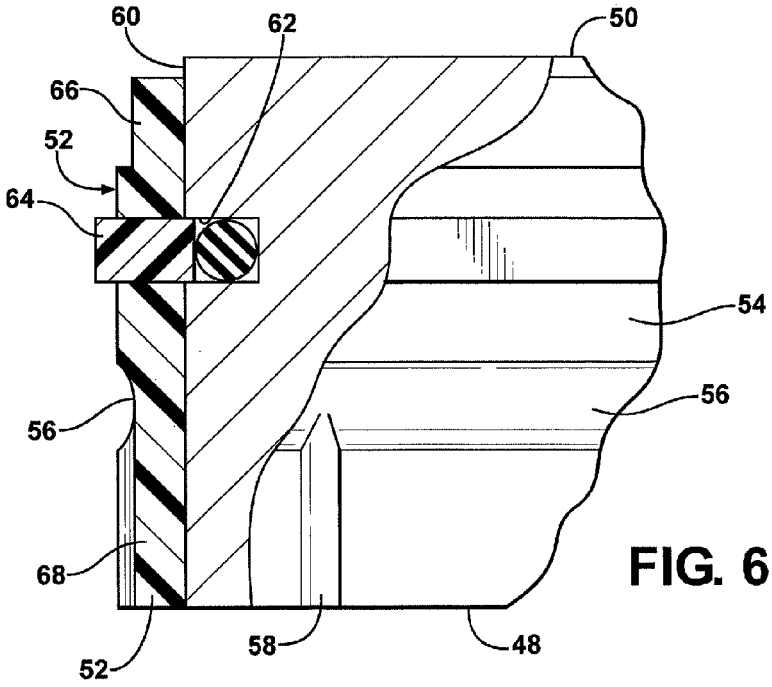
FIG. 6

HYDRAULIC SYSTEM FOR SYNCHRONIZING A PLURALITY OF PISTONS AND AN ASSOCIATED METHOD

RELATED APPLICATION

This application claims priority to and the benefit of U.S. Provisional Patent Application No. 61/144,868, filed on Jan. 15, 2009.

FIELD OF THE INVENTION

The present invention generally relates to a hydraulic system, and more specifically, to a hydraulic system that can rephase and synchronize a plurality of pistons.

BACKGROUND

Hydraulic systems utilizing a pressurized fluid through a series of pistons is generally known in the art. Typically, it is important to have these pistons synchronized with respect to one another. In other words, it is desirable to have these pistons reach the top and the bottom of their respective strokes at the same time. This can be especially desirable when raising and lowering components of a piece of equipment.

During use of these types of hydraulic systems the pistons may get out of sync due to the wear of various parts on the pistons. Most commonly, seals can wear and begin to degrade over time allowing the fluid within the system to bypass the pistons and leak out of the system. When the fluid is removed from the system, by leaking or otherwise, a decrease in pressure within the system occurs causing the pistons to travel at varying speeds thereby causing the pistons to begin and end their strokes at different times. In applications such as those described above, i.e. raising and lowering components of equipment, the variation in piston movement will not allow the components of the move smoothly and safely. To remedy this problem, the pistons need to be resynced. The process of resyncing the pistons is commonly known in the art as rephasing.

There have been various attempts in the prior art to rephase hydraulic systems. One such system disclosed in U.S. Pat. No. 3,832,852 to Schmucker requires that a groove be placed on the interior surface of the cylinder wall to allow fluid to bypass the cylinder when the piston is in a rephasing position. With such a design, the seal around the piston has a tendency to deform into the groove as the piston moves past the groove. Over time the portion of the deformed seal will shear off and not allow that cylinder to maintain pressure therein.

Another design taught in U.S. Pat. No. 7,537,079 to Krieger et al. requires a longitudinal hole defined by a face of the piston that meets a radial hole defined by a side face of the piston, creating a passageway through the piston. A check valve is place within the passage way to automatically allow fluid to flow from a first cylinder to a second cylinder, but not from the second cylinder back to the first cylinder. Although effective to rephase the hydraulic system, this design is cumbersome and expensive to manufacture.

Therefore there remains a need in the art for a hydraulic system that will allow the pistons to be automatically rephased and is both easy to use and inexpensive to manufacture.

SUMMARY OF THE INVENTION

The present invention provides a hydraulic system utilizing a pressurized fluid. The system comprises a first cylinder and a second cylinder spaced from the first cylinder. A flow path is disposed between the first and second cylinders for linking the cylinders in fluid communication with each other. A first piston is disposed within the first cylinder and defines a first axis and a second piston disposed within the second cylinder. The first piston is movable along the first axis between a plurality of operating positions and a rephasing position. The first piston has a first exterior surface defining a first peripheral groove and a plurality of first flutes disposed parallel to the first axis and intersects the first peripheral groove for allowing the fluid to flow from the first cylinder across the flow path and into the second cylinder when the first piston is in the rephasing position.

The present invention further provides that each of the pistons have a body portion including a bottom face and a top face spaced from each other. The exterior surface is disposed between the bottom face and the top face.

The present invention still further provides a method of rephasing the hydraulic system utilizing the pressurized fluid. The method comprises the step of moving the first piston along the axis from one of a plurality of operating positions to the rephasing position for aligning the peripheral groove with the flow path. The method further comprises the steps of flowing the fluid from the first cylinder through the flutes and flowing the fluid into and at least partially around the peripheral groove. The method still further comprises the steps of flowing the fluid into and through the flow path linking the first and second cylinders and flowing the fluid into the second cylinder to equalize fluid pressure between the first and second cylinders for synchronizing the first and second pistons with one another.

Accordingly, the present invention provides a hydraulic system that will automatically rephase the when the pistons become out of sync with one another. Additionally, the present invention allows the fluid to by pass the piston through the flutes and the peripheral groove when in the rephasing position, thus eliminating the need for valves or other similar components as set forth in the background section.

BRIEF DESCRIPTION OF THE DRAWINGS

Other advantages of the present invention will be readily appreciated, as the same becomes better understood by reference to the following detailed description when considered in connection with the accompanying drawings.

FIG. 4 is a perspective view of one of the pistons of the present invention.

FIG. 6 is a fragmented partially cross-sectional view of the piston.

DETAILED DESCRIPTION OF THE INVENTION

Figure 1:
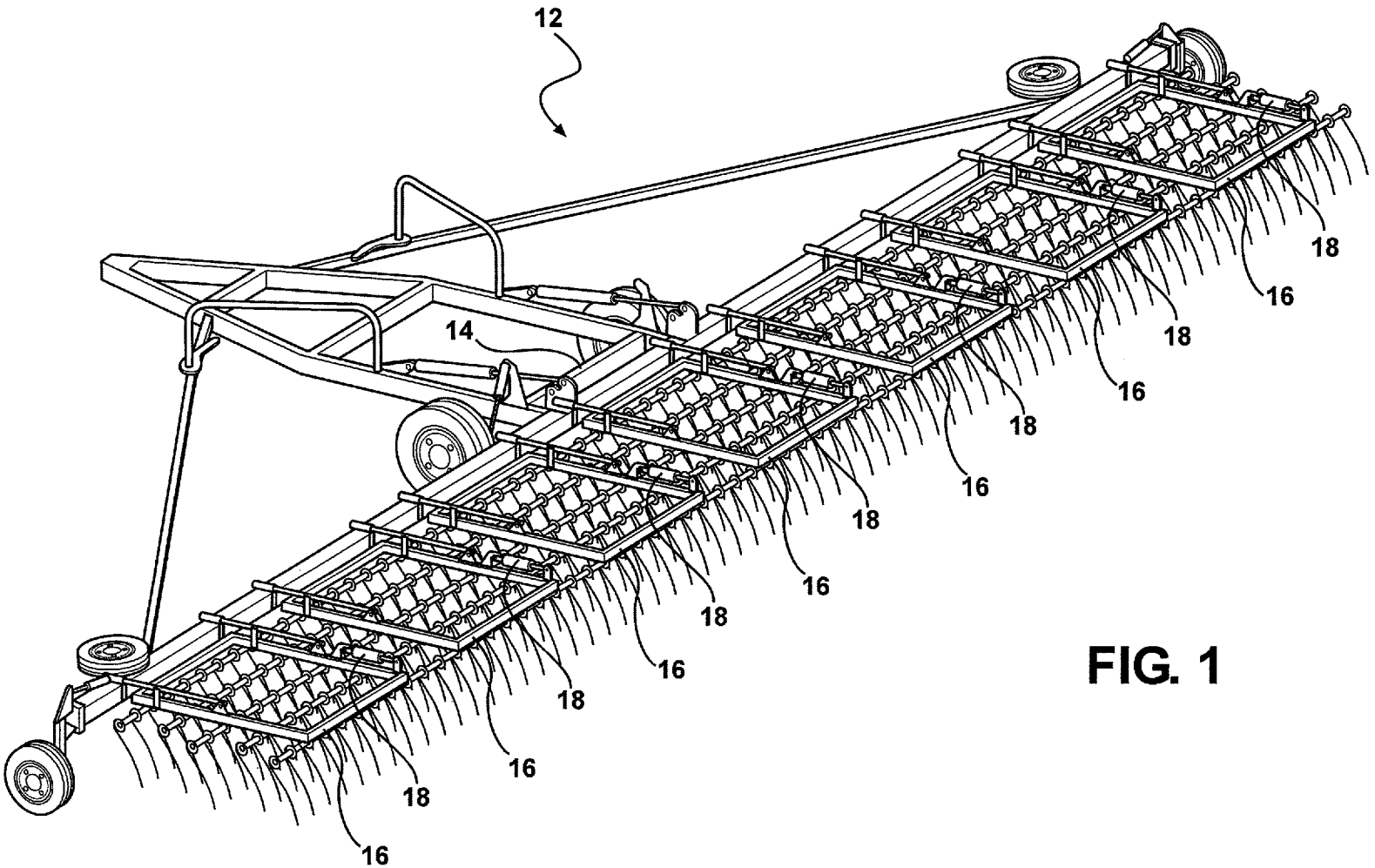
FIG. 1 is a perspective view of an agricultural machine in a working position utilizing a hydraulic system including a plurality of pistons of the present invention.
Figure 2:
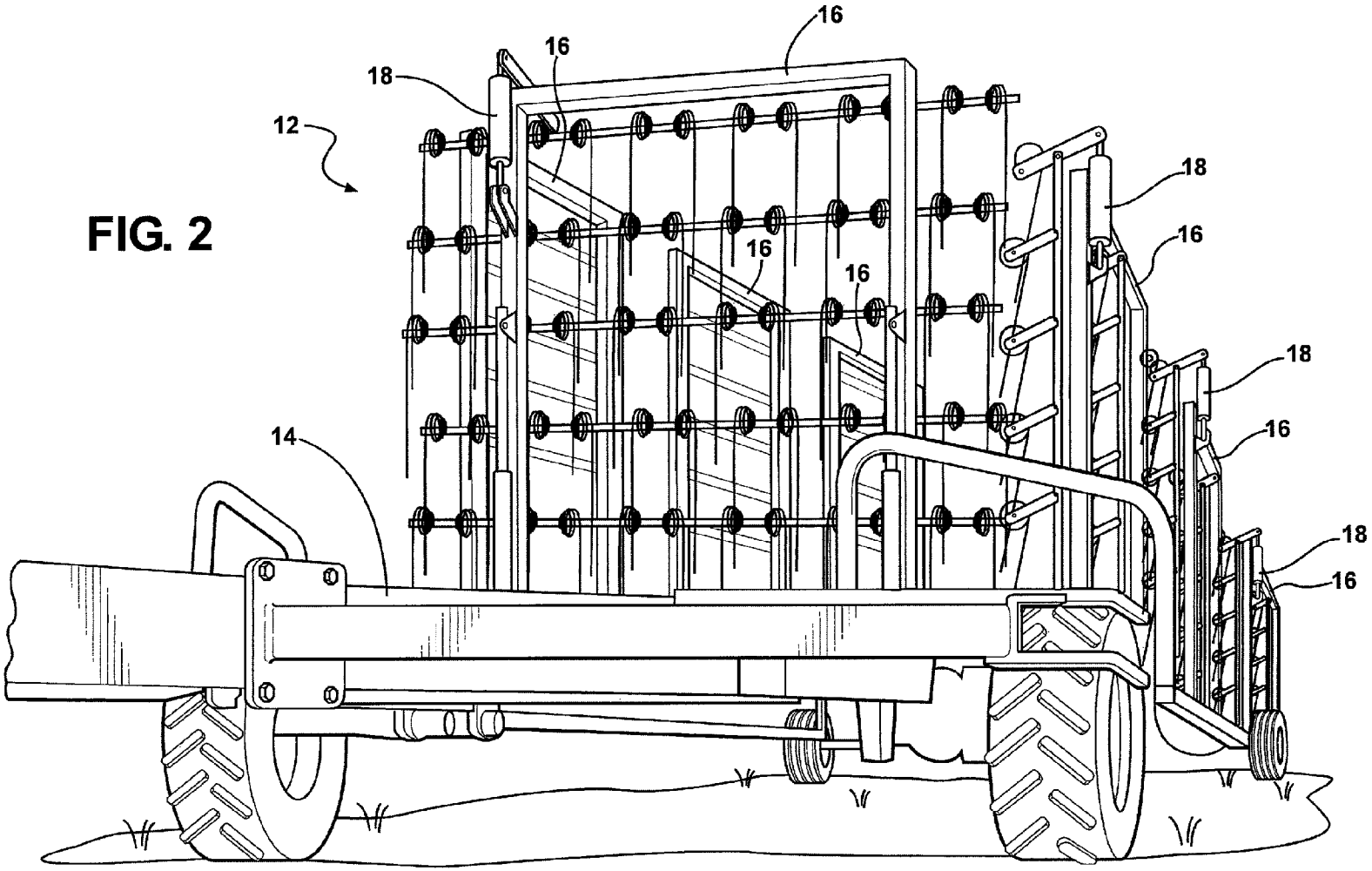
FIG. 2 is a perspective view of the agricultural machine in a stored position.

Referring to the Figures wherein like numerals indicate like or corresponding parts throughout the several views, a hydraulic system 10 disposed on an agricultural machine 12 is shown in FIGS. 1 and 2. The agricultural machine 12 includes a main body 14 and a plurality of arms 16 extending out from the main body 14. Specifically, FIG. 1 illustrates the agricultural machine 12 in a working position with the arms 16 extended, and FIG. 2 illustrates the agricultural machine 12 in a stored position with the arms 16 folded up to transport and/or store the agricultural machine 12 when not in use. In moving the agricultural machine 12 between the working position and the stored position, it is desirable that the arms 16 move at substantially the same rate and get to either the working position or the stored position at substantially the same time. In other words, it is desirable that the arms 16 move in a synchronized fashion. To achieve this synchronized movement, the hydraulic system 10 including a plurality of cylinders 18 is used to regulate and synchronize the movement between the working position and the stored position and vice versa.

However, it is to be appreciated that the hydraulic system 10 is not limited to use in agricultural machines. The present invention may be used in any other device or application requiring a series of pistons 40 within a hydraulic system.

Figure 3:
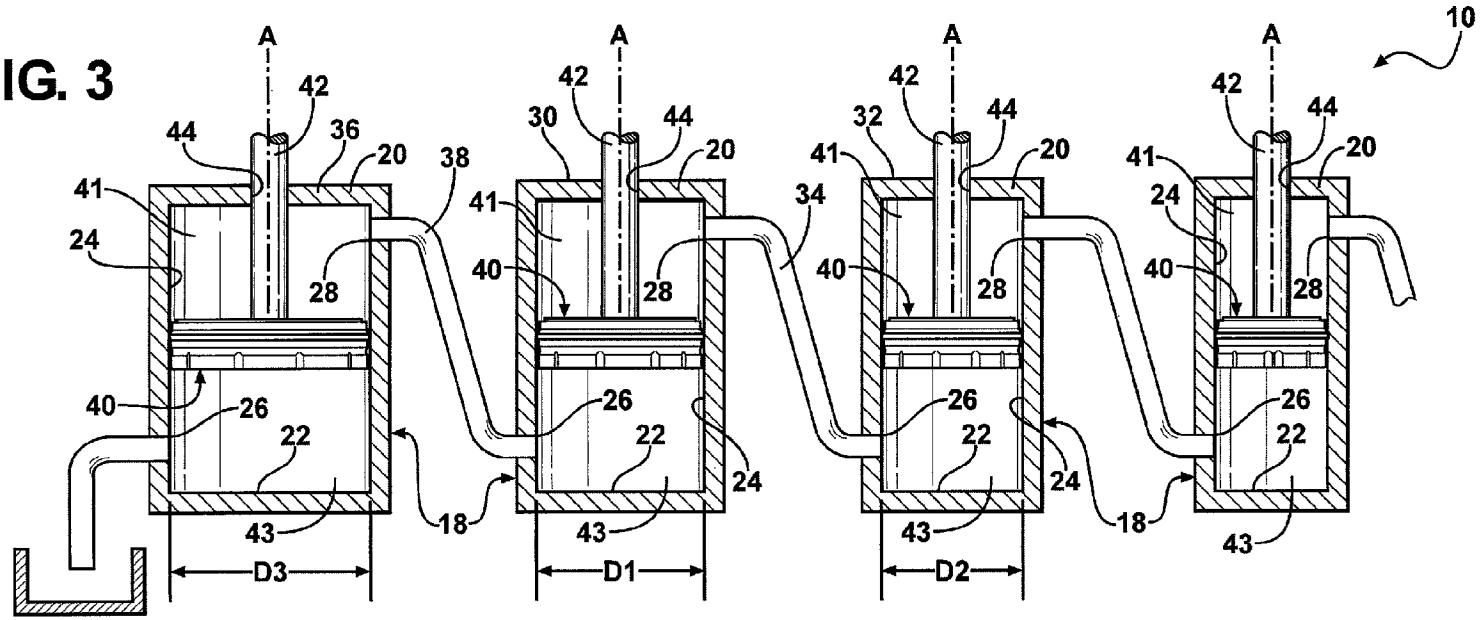
FIG. 3 is a schematic partially cross-sectional side view of the hydraulic system utilizing the pistons of the present invention.

As shown in FIG. 3, the hydraulic system 10 of the present invention typically has the cylinders 18 arranged in series. However, it should be appreciated that any other arrangement of the cylinders will not deviate from the subject invention. Each of the cylinders 18 include a top wall 20 and a bottom wall 22 spaced from and substantially parallel to the top wall 20. A side wall 24 having a generally circular configuration is disposed between and substantially perpendicular to the top wall 20 and the bottom wall 22 forming a closed cylindrical chamber. It is to be appreciated that the cylinders 18 may define any other appropriate configuration. The side wall 24 of each of the cylinders 18 define an inlet orifice 26 and an outlet orifice 28 spaced from the inlet orifice 26. In an illustrative embodiment, the inlet orifice 26 is disposed approximately 180 degrees from the outlet orifice 28 about the side wall 24 of the cylinders 18. However, any other relationship between the inlet orifice 26 and outlet orifice 28 may be employed without deviating from the subject invention.

The plurality of cylinders 18 are further defined as a first cylinder 30, having a first diameter D1, and a second cylinder 32, having a second diameter D2, spaced from the first cylinder 30. The first diameter D1 is greater than the second diameter D2. Accordingly, the first cylinder 30 defines a first volume and the second cylinder 32 defines a second volume with the first volume being greater than the second volume. A first flow path 34 is disposed between the first 30 and second 32 cylinders linking the outlet orifice 28 of the first cylinder 30 in fluid communication with the inlet orifice 26 of the second cylinder 32. The cylinders 18 are still further defined as a third cylinder 36, having a third diameter D3 and defining a third volume spaced from the first cylinder 30. The third diameter D3 is greater than the first diameter D1 and the third volume is greater than the first volume. A second flow path 38 is disposed between the third cylinder 36 and the first cylinder 30 linking the outlet orifice 28 of the third cylinder 36 in fluid communication with the inlet orifice 26 of the first cylinder 30. It is preferred that the volume of each preceding cylinder is greater than each subsequent cylinder when the cylinders 18 are arranged in series. Additionally, it is to be appreciated that additional or fewer cylinders may be utilized within the hydraulic system 10 without deviating from the subject invention.

The hydraulic system 10 further includes a plurality of pistons 40. One of the pistons 40 is disposed in each of the cylinders 18 and is configured to slidingly engage the respective cylinder. The pistons 40 divide each of the cylinders into an upper chamber 41 and a lower chamber 43. Typically the outlet orifice 28 is in the upper chamber 41 of the cylinders 18 and the inlet orifice 26 is in the lower chamber 43 for accepting the fluid therein. The fluid is typically only in the lower chamber 43 of the cylinders 18.

A rod 42 is coupled to each of the pistons 40 to transfer useful work performed by each of the pistons 40 out of the cylinders 18. The rod 42 may be fixed to each of the pistons 40 by any appropriate manner, such as welding or using a fastening system. The top wall 20 defines an opening 44 to allow the rod 42 to pass through and attach to an external component, such as the agricultural machine 12 described above, to be driven by the hydraulic system 10.

Each of the pistons 40 are substantially similar to one another with the exception that each of the pistons 40 have a different diameter than the adjacent pistons 40 which corresponds to the diameter of their respective cylinder. In the interest of brevity, only one of the pistons 40 will be discussed in detail. Unless otherwise indicated, the discussion below may be applied to all of the pistons 40 and corresponding cylinders 18 within the hydraulic system 10. The pistons 40 will therefore be referred to in the singular, i.e. piston 40.

The piston 40 is disposed within the cylinder and defines an axis A and is movable along the axis A between a plurality of operating positions and a rephasing position. The operating positions are defined as when the piston is producing useful work output for the hydraulic system 10. The rephasing position is defined as when the hydraulic system 10 is synchronizing the position of the piston 40 with the other pistons in the hydraulic system 10. The rephasing process will be described in greater detail below.

Figure 5:
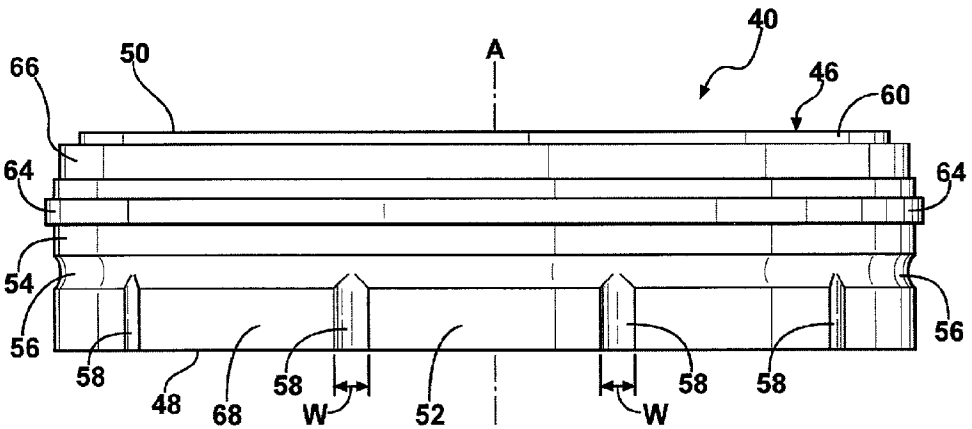
FIG. 5 is a side view of the piston.

Referring now to FIGS. 4 and 5, the piston 40 comprises a body portion 46. The body portion 46 includes a bottom face 48 and a top face 50 spaced from the bottom face 48. Typically the bottom face 48 is substantially parallel to the top face 50. However, it should be appreciated that other orientational relationships between the bottom 48 and top 50 faces may be utilized without deviating from the subject invention. An exterior surface 54 is disposed between the bottom face 48 and the top face 50. The exterior surface 54 defines a peripheral groove 56 about the exterior surface 54 and transverse to the axis A. Additionally, the exterior surface 54 defines a plurality of flutes 58 intersecting the peripheral groove 56. Typically the flutes 58 link the bottom face 48 and the peripheral groove 56 in fluid communication. Each of the flutes 58 define a concave configuration and a primary width W that may taper into the peripheral groove 56 for directing the fluid into and at least partially around the peripheral groove 56. The flutes 58 are typically axially spaced equally about the exterior surface 54 for guiding the fluid into the peripheral groove.

The exterior surface 54 further defines a circumferential recess 62 spaced from and substantially parallel to the peripheral groove 56. A sealing ring 64 is disposed within the circumferential recess 62. The sealing ring 64 seals the piston 40 against the side wall 24 of the cylinder 18 to prevent the fluid from bypassing the piston 40 when in the operating positions. Additionally, the sealing ring 64 helps to keep the piston 40 centered within the cylinder 18.

As best shown in FIG. 6, a polymeric coating 52 defines the exterior surface 54 of the piston 40 including the peripheral groove 56 and the flutes 58. The body portion 46 of the piston 40 further includes an outer surface 60. The polymeric coating 52 is fixedly secured to the outer surface 60 of the piston 40 using any suitable method known to one skilled in the art. The circumferential recess 62 and the sealing ring 64 divide the polymeric coating 52 into an upper portion 66 and a lower portion 68. The peripheral groove 56 and the flutes 58 are disposed in the lower portion 68 of the polymeric coating 52. In other embodiments the polymeric coating 52 may be excluded form the piston 40 and the peripheral groove 56 and the flutes 58 may be defined by the outer surface 60 of the body portion 46.

Figure 7:
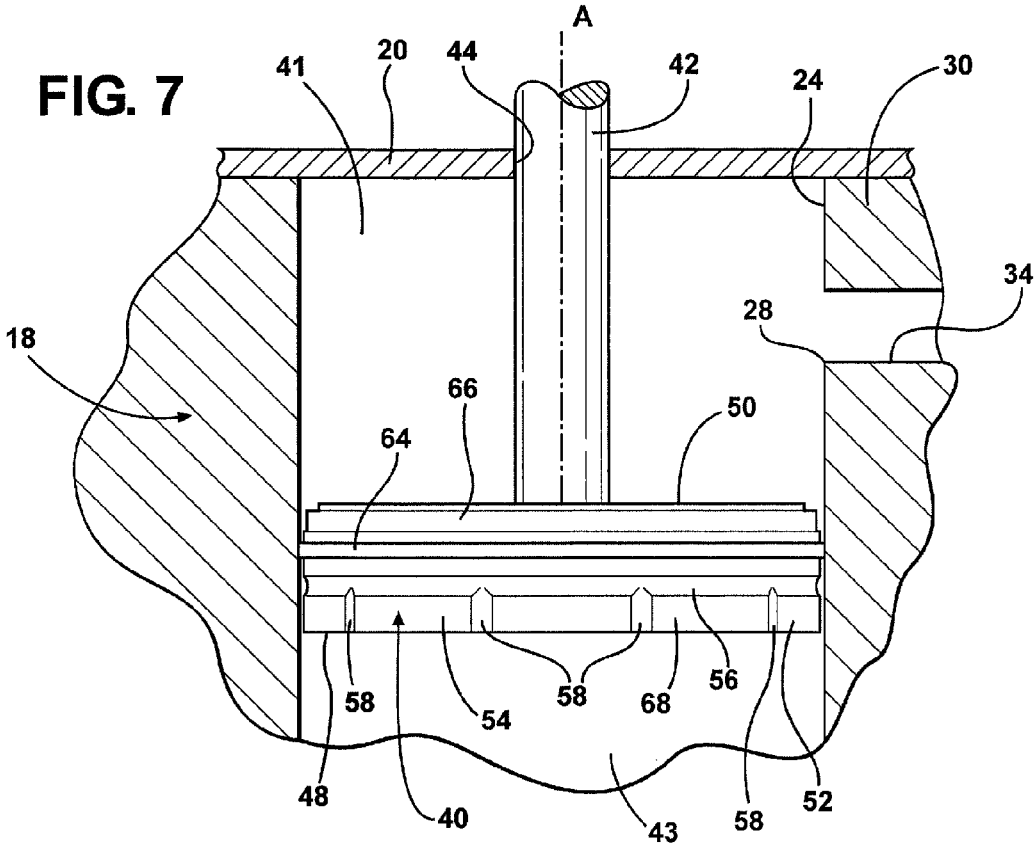
FIG. 7 is a fragmented partially cross-sectional side view of one of the pistons in an operational position.

For illustrative purposes only, the operation of the hydraulic system 10 of the present invention will be discussed. Referring to FIGS. 3 and 7, the pistons 40 are each shown in one of the operating positions with the sealing ring 64 preventing fluid to bypass the piston 40. During operation, the pistons 40 may become out of sync with one another. This may occur due to varying loads being placed on each rod 42 causing slippage of the piston 40 relative to the side wall 24 or if the fluid leaks past the sealing ring 64 thereby lowering the pressure of the fluid against the piston 40. When the fluid pressure is different between the cylinders 18, the pistons are going to operate at different rates of speed causing each of the pistons 40 to begin and end their strokes at varying times relative to one another. A rephasing operation is needed to bring the pistons 40 back in sync with each other.

Figure 8:
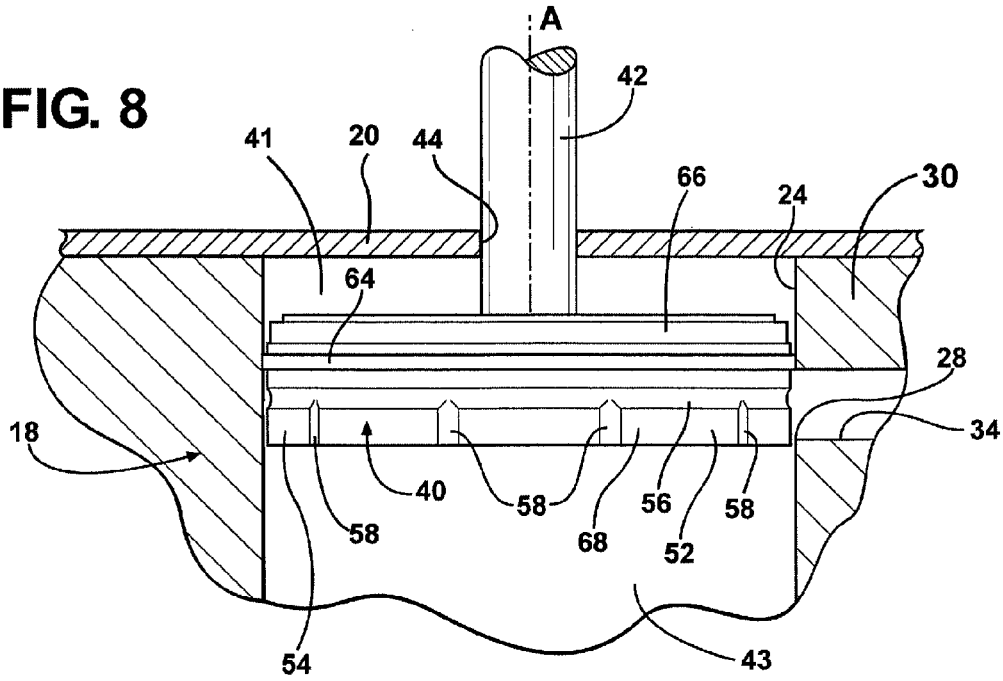
FIG. 8 is a fragmented partially cross-sectional side view of one of the pistons in a rephasing position.

Referring now to FIG. 8, when the pistons 40 need to be rephased, the pistons 40 move to the rephasing position. In the rephasing position, the sealing ring 64 moves past the outlet orifice 28 and allows the peripheral groove 56 to become aligned with the outlet orifice 28. The fluid is allowed to flow into the flutes 58 and into and around the peripheral groove 56. The fluid may then flow into the outlet orifice 28 and through the flow path to the inlet orifice 26 of the adjacent cylinder. The fluid pressure is thereby increased because of the added fluid in the adjacent cylinder equalizing the pressure between the cylinders 18. The pistons 40 are then moved back into the operating positions until the hydraulic system 10 needs to be rephased again.

The present invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than specifically described within the scope of the appended claims.

What is claimed is:

1. A hydraulic system utilizing a pressurized fluid, said system comprising:
- a first cylinder;
- a second cylinder spaced from said first cylinder;
- a flow path disposed between said cylinders for linking said first and second cylinders in fluid communication with each other;
- a first piston disposed within said first cylinder and defining a first axis with said first piston movable along said first axis between a plurality of operating positions and a rephasing position and said first piston having a first exterior surface defining a first peripheral groove;
- a second piston disposed within said second cylinder; and
- said first exterior surface of said first piston further defining a plurality of first flutes disposed parallel to said first axis and intersecting said first peripheral groove for allowing the fluid to flow from said first cylinder across said flow path and into said second cylinder when said first piston is in said rephasing position for synchronizing said first and second pistons.

2. The system as set forth in claim 1 wherein said second piston defines a second axis with said second piston movable along said second axis within said second cylinder between a plurality of operating positions and a rephasing position and said second piston having a second exterior surface defining a second peripheral groove and a plurality of second flutes disposed parallel to said second axis and intersecting said second peripheral groove.

3. The system as set forth in claim 1 further including a third piston disposed within a third cylinder and defining a third axis with said third piston presenting a third exterior surface defining a third peripheral groove and a plurality of third flutes axially spaced about the third exterior surface intersecting said third peripheral groove and a second flow path linking the first and third cylinders in fluid communication with one another for allowing the fluid to flow from said third cylinder across said second flow path and into said first cylinder when said third piston is in said rephasing position for synchronizing said third piston and said first piston.

4. The system as set forth in claim 3 wherein said first piston has a first diameter and said second piston has a second diameter and said third piston has a third diameter with said third diameter greater than said first and second diameters and said first diameter is greater than said second diameter.

5. The system as set forth in claim 4 wherein said first piston further includes a bottom face intersecting said first exterior surface with said flutes interconnecting said bottom surface and said peripheral groove in fluid communication.

6. The system as set forth in claim 1 wherein said first piston further includes a polymeric coating defining said exterior surface having said flutes and said peripheral groove.

7. The system as set forth in claim 1 wherein said flutes are equally spaced along said exterior surface.

8. The system as set forth in claim 1 wherein said flutes are further defined as having a concave configuration.

9. The system as set forth in claim 1 wherein said flutes define a primary width tapering into said peripheral groove.

10. The system as set forth in claim 1 wherein said exterior surface further defines a circumferential recess and a sealing ring is disposed within said circumferential recess.

11. The system as set forth in claim 10 wherein said sealing ring is spaced from and above said peripheral groove.

12. A piston for use in a hydraulic system utilizing a pressurized fluid, said piston comprising:
- a body portion defining an axis with said body portion including;
  - a bottom face and a top face spaced from each other;
  - an exterior surface disposed between said bottom face and said top face with said exterior surface defining a peripheral groove transverse to said axis; and
  - said exterior surface of said piston further defining a plurality of flutes spaced axially from each other and intersecting said peripheral groove for guiding the fluid from one of said faces into said peripheral groove;
  - wherein said exterior surface further defines a circumferential recess and a sealing ring is disposed within said circumferential recess.

13. The piston as set forth in claim 12 further including a polymeric coating defining said exterior surface having said flutes and said peripheral groove.

14. The piston as set forth in claim 12 wherein said flutes are equally spaced along said exterior surface.

15. The piston as set forth in claim 12 wherein said flutes are further defined as having a concave configuration.

16. The piston as set forth in claim 12 wherein said flutes define a primary width tapering into said peripheral groove.

17. The piston as set forth in claim 12 wherein said sealing ring is spaced from and above said peripheral groove.

18. A method of rephasing a hydraulic system utilizing a pressurized fluid and having a first piston presenting an exterior surface defining a peripheral groove and a plurality of flutes axially spaced about the exterior surface and intersecting the peripheral groove, the first piston is disposed within a first cylinder defining a axis and further including a second piston disposed within a second cylinder and a flow path linking the first and second cylinders in fluid communication with one another, said method comprising the steps of:

moving the first piston along the axis from one of a plurality of operating positions to a rephasing position for aligning the peripheral groove with the flow path;

flowing the fluid from the first cylinder through the flutes;

flowing the fluid into and at least partially around the peripheral groove;

flowing the fluid into and through the flow path linking the first and second cylinders; and flowing the fluid into the second cylinder to equalize fluid pressure between the first and second cylinders for synchronizing the first and second pistons with one another.

19. The method as set forth in claim 18 wherein said flowing said fluid at least partially around the peripheral groove is further defined as flowing the fluid completely around the peripheral groove.

20. The method as set forth in claim 18 wherein said flowing the fluid into the flow path occurs automatically when the first piston is in the rephasing position.

21. A piston for use in a hydraulic system utilizing a pressurized fluid, said piston comprising:

a body portion defining an axis with said body portion including;

a bottom face and a top face spaced from each other;

an exterior surface disposed between said bottom face and said top face with said exterior surface defining a peripheral groove transverse to said axis;

said exterior surface of said piston further defining a plurality of flutes spaced axially from each other and intersecting said peripheral groove for guiding the fluid from one of said faces into said peripheral groove; and a polymeric coating defining said exterior surface having said flutes and said peripheral groove.

* * * * *